United States Patent [19]

Ruger

[11] Patent Number: 4,658,528

[45] Date of Patent: Apr. 21, 1987

[54] REVOLVER HANDLE STRUCTURE

[75] Inventor: William B. Ruger, Croydon, N.H.

[73] Assignee: Sturm, Ruger & Company, Inc., Southport, Conn.

[21] Appl. No.: 716,730

[22] Filed: Mar. 27, 1985

[51] Int. Cl.[4] ..... F41C 23/00

[52] U.S. Cl. ..... 42/71.02

[58] Field of Search ..... 42/71 P, 59, 71 R, 72

[56] References Cited

U.S. PATENT DOCUMENTS

| | | | |
|---|---|---|---|
| 1,228,506 | 6/1917 | Wesson | 42/71 P |
| 2,903,811 | 9/1959 | Freed | 42/71 P |
| 3,672,084 | 6/1972 | Pachmayr | 42/71 P |
| 4,342,170 | 8/1982 | Hogue et al. | 42/71 P |

*Primary Examiner*—Deborah L. Kyle
*Assistant Examiner*—Ted L. Parr
*Attorney, Agent, or Firm*—Pennie & Edmonds

[57] ABSTRACT

A handgun grip arrangement in which both large and small grip panels may be interchangeably accommodated. A grip frame projection substantially smaller than the large grip depends from and forms part of the handgun frame.

Pairs of large or pairs of small grip panels are opposingly positioned on opposite sides of the frame projection which grip panels have border engagement surfaces and frame projection engagement areas which surfaces are drawn into engagement and which engagement areas are caused to engage such frame projection by operation of fastener means.

4 Claims, 12 Drawing Figures

REVOLVER HANDLE STRUCTURE

BACKGROUND OF THE INVENTION

Numerous arrangements have been proposed for mounting handle grips on the grip frames of handguns including cushioned handgrips and grips made of solid materials such as wood, plastic, or ivory.

In prior proposals and prior practices each handgun was designed to accommodate a particular handgrip or group of handgrips having limited variations and, therefore, such prior designs lacked versatility.

While grip frame varying in size and shape have been utilized, the alignment and ready attachment of varying grip panels has not been satisfactory.

SUMMARY OF THE INVENTION

Broadly, the present invention comprises a handgun grip frame substantially smaller than the handgun handle which grip frame projection receives and holds a plurality of resilient or rigid grip panel sets. The grip frame and grip panel sets are so shaped that each grip panel engages its opposing grip panel in selected areas only while at the same time each panel engages the grip frame projection in particular areas only.

DESCRIPTION OF THE PREFERRED EMBODIMENT

Figure 1:
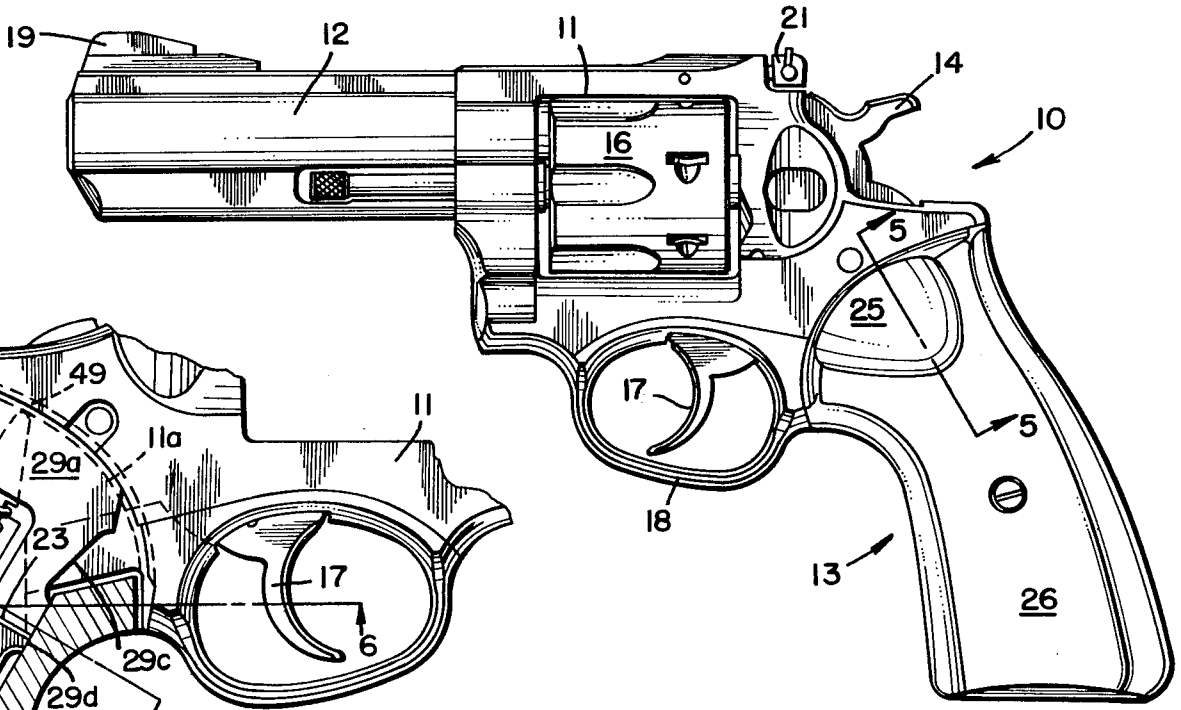
FIG. 1 is a side elevational view of a revolver of this invention.
Figure 2:
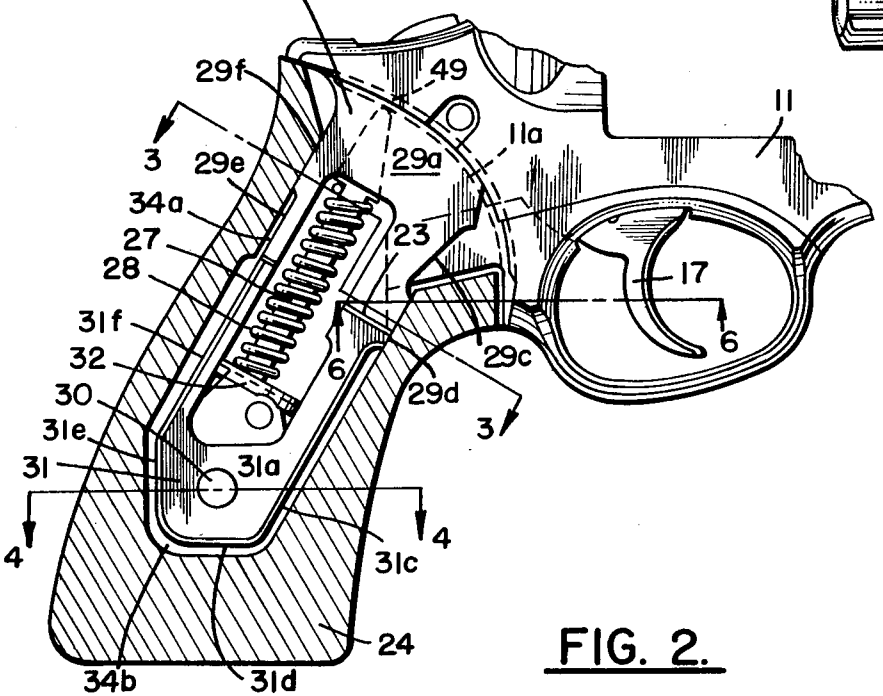
FIG. 2 is a partial side elevational cutaway view of the frame handle and trigger area of the revolver.
Figure 6:
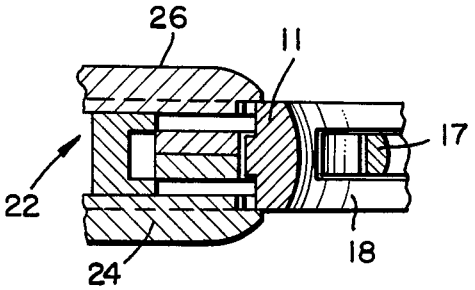
FIG. 6 is a sectional view along line 6—6 of FIG. 2.
Figure 5:
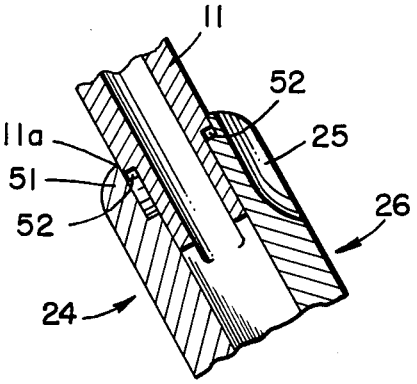
FIG. 5 is a sectional view along line 5—5 of FIG. 1.

In FIGS. 1 and 2, revolver 10 includes frame 11, barrel 12, handle 13, hammer 14, cylinder 16, trigger 17, trigger guard 18, and front and rear sights respectively 19 and 21.

Figure 3:
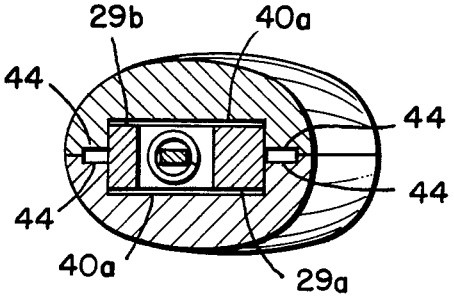
FIG. 3 is a sectional view along line 3—3 of FIG. 2.
Figure 4:
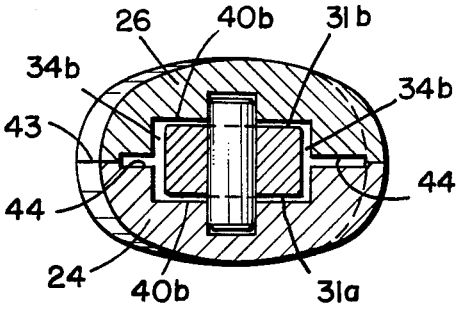
FIG. 4 is a sectional view along line 4—4 of FIG. 2.

Handle 13 comprises frame grip projection 22 and right and left grip panels 24, 26 respectively (see also FIG. 4). Panel 26 includes exterior recess 25. Hammer strut 27 and hammer spring 28 are located within grip projection 22. Grip projection 22 includes an upper portion 29 and a lower portion 31. Tapered bevel 23 delineates where grip projection 22 changes in thickness. Upper larger portion 29 includes right side wall 29*a* and left side wall 29*b* (FIG. 3) and end wall segments 29*c*, 29*d*, 29*e*, and 29*f* and likewise lower portion 31 has right side walls 31*a*, left side wall 31*b* and end walls 31*c*, 31*d*, 31*e*, and 31*f* (see also FIGS. 4 and 9). Lower projection portion 31 carries grip pins 30, one on each side wall 31*a* and 31*b*. Hammer strut 27 is secured to base piece 32 (see also FIG. 10).

Referring further to FIGS. 3–9, grip panels 24, 26 may be made of a resilient or rigid material such as rubber, resin, plastic, wood, steel, or combinations thereof. Panels 24, 26 which are made of hard rubber are deformable in the sense that they will bend, compress or otherwise deform under the forces applied when fastened to the grip projection and to each other. Alternatively, rigid panels may be used such as wooden panels. Each grip panel 24, 26 has an interior grip frame-receiving recess 35 having upper side recess wall 34*a*, lower side recess wall 34*b*, end recess walls 36*a*, 36*b*, 36*c*, 36*d*, and 36*f* and a grip pin recess 37. Recess 35 has more depth above ledge 33 than below ledge 33 to accommodate for the variation in thickness of grip frame projection 22. The grip panel recesses 35 and the grip frame projection 22 are shaped and positioned so that each of grip panels 24, 26 is mounted on the grip projection 22 at four (4) locations. There is engagement between end wall 29*d* and end recess wall 36*b* and between end wall 29*f* and end recess wall 36*f*. Finally, there is engagement of pin 30 in panel pin recess 37. While four (4) engagement areas are preferred for each panel 24, 26, any number of areas may be used for each panel 24, 26 provided each panel is stabilized on and held tightly to grip frame projection 22. Recesses 35 and grip frame projection 22 are also shaped and sized to be spaced apart providing substantial non-engagement areas thus leaving (a) upper side openings 40*a* and lower side openings 40*b* between side walls 29*a*, 29*b*, 31*a*, 31*b* of grip projection 22 and (b) upper end openings 34*a* and lower end openings 34*b* between the grip projection and panels (see FIGS. 3 and 4).

Figure 7:
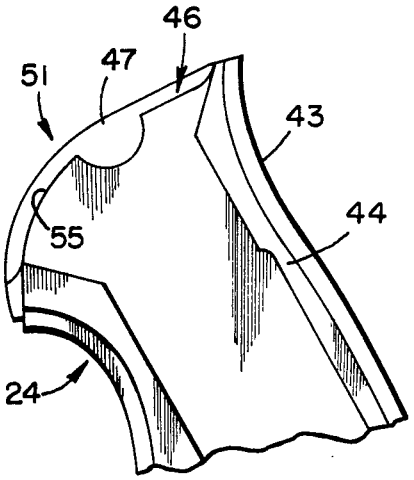
FIG. 7 is a partial elevational view of a grip panel showing an internal recess and notches.

Panels 24, 26 have periphery border mating surfaces 43 which engage and, in the case of resilient grips, deform as necessary to form a seal between panels 24, 26 as they are affixed to the revolver handle 13 (see FIG. 7). Border engagement surfaces 43 preferably extend along the entire panel border except the upper edges which engage the frame 11. The width of the border surfaces 43 is relatively narrow to provide for a better engagement as panels 24, 26 deform under the forces applied to them. Interior of border surfaces 43 are panel notches 44 which determine the width of the border surfaces 43. Upper panel arcuate recess notch 46 includes arcuate border surface 47 which engages frame surface 11*a*.

Figure 8:
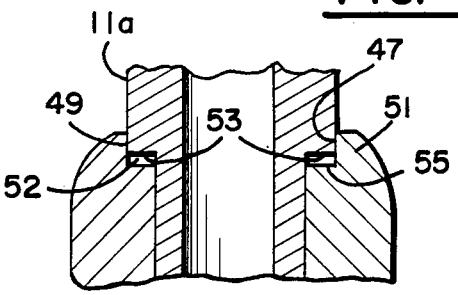
FIG. 8 is a partial enlarged view of FIG. 5.

In addition spacing between the frame 11 and the upper portion of each panel 24, 26 is accomplished through formation of an arcuate frame notch 49 (see FIGS. 7 and 8). Each panel notch 46 and frame notch 49 are formed such that the arcuate panel lip portion 51 (with its interior arcuate border surface 47) lies on the frame surface 11*a* while at the same time leaving an arcuate space 52 between the arcuate lip portion 51 of the panel and the end surface 53 of frame notch 46. Frame arcuate notch 46 includes arcuate frame end surface 53 and the frame arcuate surface 11*a* (see FIG. 8). Panel notches 46 each include panel arcuate ends 55 and panel arcuate border areas 47 (see again FIGS. 7 and 8).

Side openings 40*a*, 40*b*, end openings 34*a*, 34*b*, and arcuate spaces 52 between the grip frame projection 22 and panels 24, 26 permit attachment of the panels at the four (4) locations described above without interference between the projection and panels at other locations. Since the panels and the projection have dimensional variations due to tolerances, manufacturing conditions, and other reasons, such openings and spaces are made large enough to avoid interference between the panels and projection at those locations. In addition, such spaces may be made even larger to provide for more deformation of the grip panels as operated under the forces of an operator's hand. In particular, side spaces are provided to permit drawing the panels together using fastener means as further described to cause right panel border engagement surfaces 43 to engage left panel border engagement surfaces 43 prior to the panel recess surfaces 34*a*, 34*b* engaging projection sides 29*a*, 29*b*, 31*a*, 31*b*. Panels 24, 26 deform to provide a good fit against one another and against the arcuate frame sides 11*a*.

While resilient grips are particularly well adopted to the grip frame 22, the grip frame structure itself is equally well adopted to grip panels made of more rigid materials such as wood, plastic, or ivory, to name a few. The method of affixing the grip panels 24, 26 to grip frame 22 at points 30, 29*f*, and 29*d*, as well as the arcuate contact surface located at 29*a*, all apply to affix rigid grip panels to the grip frame, with the deformable characteristic described above not being required for utilizing the grip panels of this invention.

Figure 9:
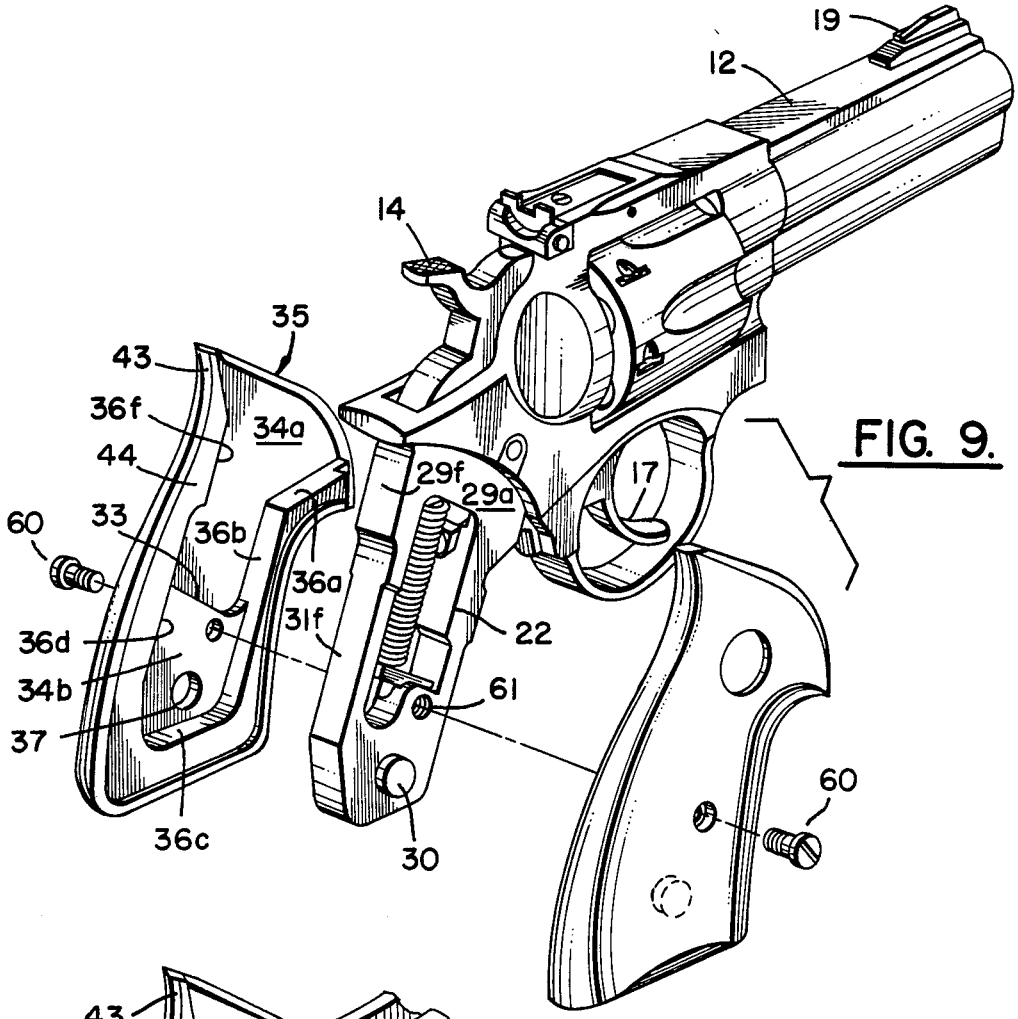
FIG. 9 is a perspective exploded view of the revolver of the invention.

Grip panels 24, 26 are drawn together and against the frame by threaded fasteners 60 screwed into threaded holes 61 in grip projection 22 (see FIG. 9).

Figure 10:
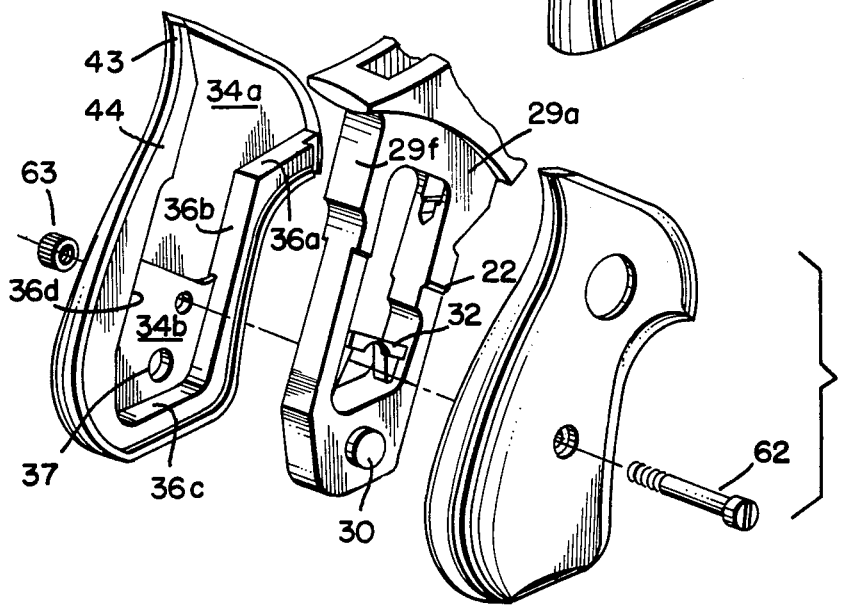
FIG. 10 is a partial perspective exploded view of an alternate embodiment of the invention.

Turning to FIG. 10, an alternative arrangement is shown for holding panels 24, 26 drawn together through a thread bolt 62 passes through one panel 24, the grip projection 22 and the other panel 26 where it receives a threaded nut 63.

Figure 11:
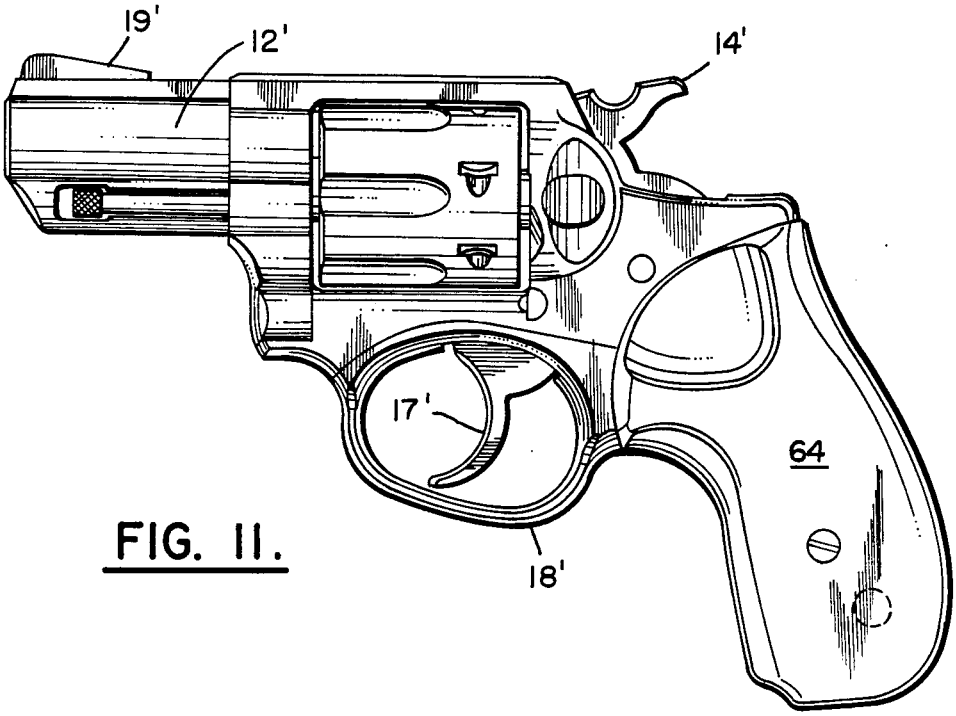
FIG. 11 is a right elevational view showing smaller grip panels positioned on the grip frame projection in accordance with the invention.
Figure 12:
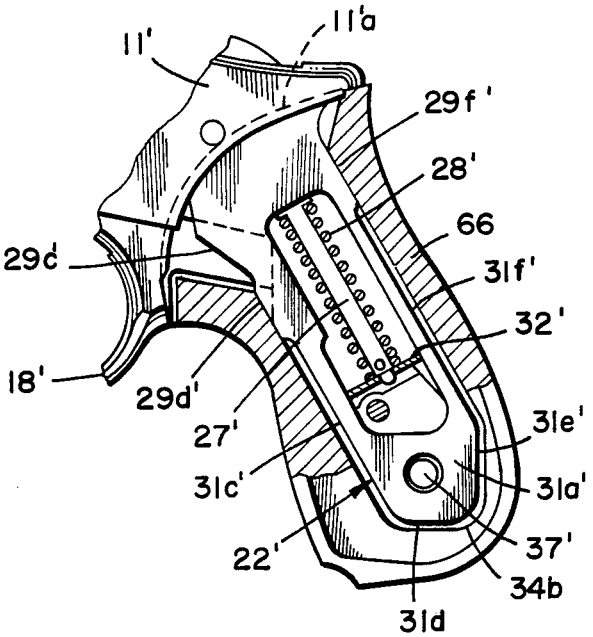
FIG. 12 is a partial elevational sectional view of the revolver handle showing smaller grip panels.

Finally, FIGS. 11 and 12, show a smaller and differently shaped pair of grip panels including left panel 64 and right panel 66 secured to the grip projection 22. Other numerals on FIGS. 11 and 12 are the same as earlier numerals on FIGS. 1–10 with primes added.

I claim:

1. In a handgun having a handle including a grip frame projection for receiving grip panels, the improvement comprising (a) a grip frame projection having a size and shape to accommodate large and small grip panels, which frame projection is substantially smaller than the large grip panels; said grip frame projection having a plurality of projection engagement areas and a plurality of projection non-engagement surfaces;

(b) a grip panel positioned on each side of the grip frame projection, each grip panel having a border engagement surface, each said panel having a plurality of panel engagement areas positioned to engage and to be held in fixed relationship with the projection engagement areas and a plurality of panel non-engagement surfaces positioned to be spaced-apart from the projection non-engagement areas; and (c) fastener means for drawing the panels against the grip frame projection to hold them in fixed relationship and for drawing the panel border engagement surfaces together;

such that the panel border engagement surfaces are urged together and the panel engagement areas and the projection engagement areas engage in fixed relationship while leaving the non-engagement surfaces spaced-apart whereby the panel and grip projection means remain in fixed relationship during operation of the handgun.

2. In a handgun having a handle including a grip frame projection for receiving and holding a pair of grip panels, the handle improvement comprising (a) a grip frame projection having right and left side surfaces and having front and rear end surfaces, such grip frame projection having a size and shape to accommodate large and small grip panels with the frame projection side surfaces being substantially smaller than the large grip panels;

(b) opposing recessed grip panels;

(c) recessed grip panels as assembled creating a combined recess with a plurality of recess walls in which the grip frame projection is located;

(d) engaging portions of each projection side and end surface engaging the recess walls with other portions of each projection side and end surface being spaced therefrom to form spaces therebetween;

(e) means for urging the opposed panels to engage said projection engaging portions with the engaging recess walls;

whereby the engaging panel-to-projection surfaces stabilize the grip panels on the grip frame projection and the recesses provide space into which each panel can locate without engagement with the grip frame projection.

3. The handle improvement of claim 1 in which the grip panels are deformable.

4. The handle improvement of claim 2 in which the frame has arcuate notch means on each side, each panel has arcuate lip portions, and each panel has arcuate notch means to permit the lip portions of the panels to engage the frame while providing a space between the panel notch means and the frame notch means.

* * * * *